US006474028B2

(12) United States Patent
Cusimano et al.

(10) Patent No.: US 6,474,028 B2
(45) Date of Patent: Nov. 5, 2002

(54) DEADMAN GROUND-ANCHOR

(76) Inventors: Matt Cusimano, 934 E. Goshen Ave., Fresno, CA (US) 93720; John Earl Howard, 680 County Rd. 1025 East, Toledo, IL (US) 62468

( * ) Notice: Subject to any disclaimer, the term of this patent is extended or adjusted under 35 U.S.C. 154(b) by 0 days.

(21) Appl. No.: 09/754,994

(22) Filed: Jan. 5, 2001

(65) Prior Publication Data

US 2002/0088186 A1 Jul. 11, 2002

(51) Int. Cl.[7] ..... E02D 5/80
(52) U.S. Cl. ..... 52/153; 52/162; 52/166
(58) Field of Search ..... 52/166, 153, 154, 52/156, 160, 162, 163; 248/156, 530

(56) References Cited

U.S. PATENT DOCUMENTS 287,923 A * 11/1883 Gorla ..... 52/154
2,243,886 A 6/1941 Scott
3,302,347 A 2/1967 Jackson
4,530,190 A 7/1985 Goodman
4,923,165 A 5/1990 Cockman
5,372,457 A 12/1994 Rante

* cited by examiner

*Primary Examiner*—Michael Safavi
(74) *Attorney, Agent, or Firm*—Robert Charles Hill

(57) ABSTRACT

A deadman ground-anchor comprises a heavy steel rod with several inches of machine threading at a back end, and an arrowhead with a pair of wedge-shaped wings at a front end. The wedge-shaped wings are welded to the steel rod. A pivotable fluke is hinged to the shaft with a lateral pin. The whole unit is driven into the soil, e.g., with a jack-hammer, until the threads at the back end are almost completely buried. A stabilizer vane and interlocking cap are then placed over the end flat on the ground. Nuts are put over the threaded end and tightened so that the whole unit is drawn back out a few inches. The fluke folds out perpendicular to the shaft and locks compacted soil between it and the cap. The stabilizing vane braces the top end of the anchor against lateral forces.

4 Claims, 3 Drawing Sheets

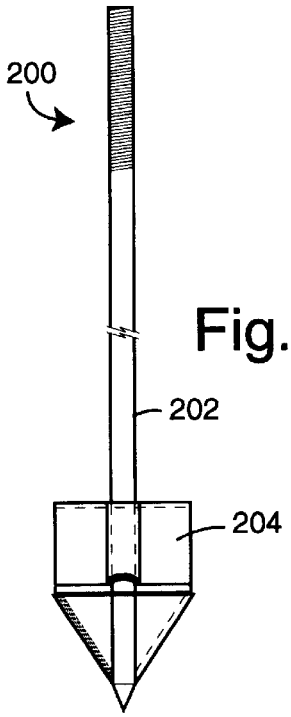
Fig. 2A
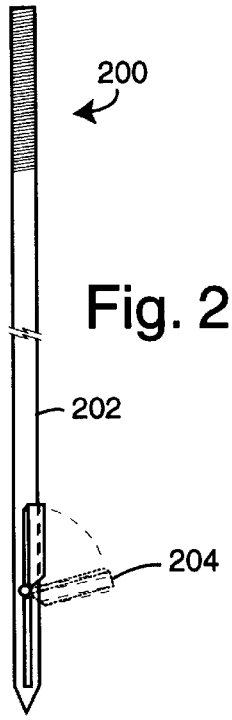
Fig. 2B
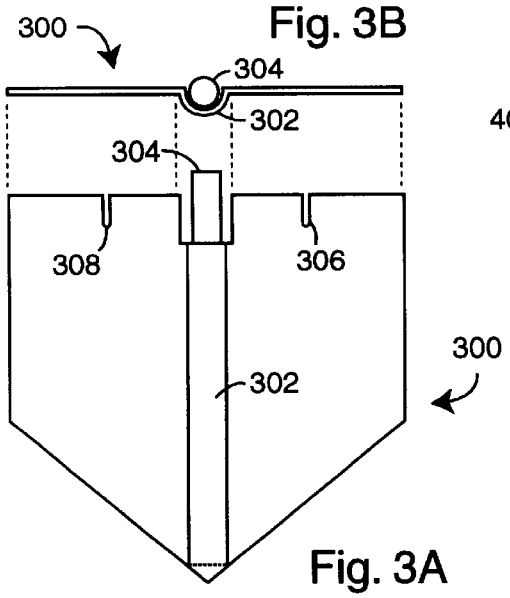
Fig. 3B
Fig. 3A
Fig. 4B
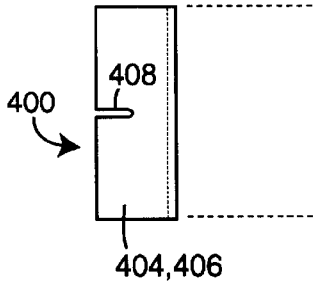
Fig. 4A
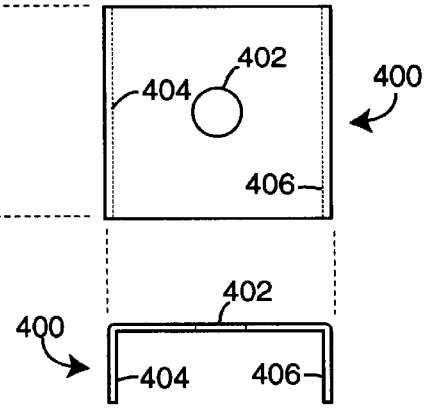
Fig. 4C

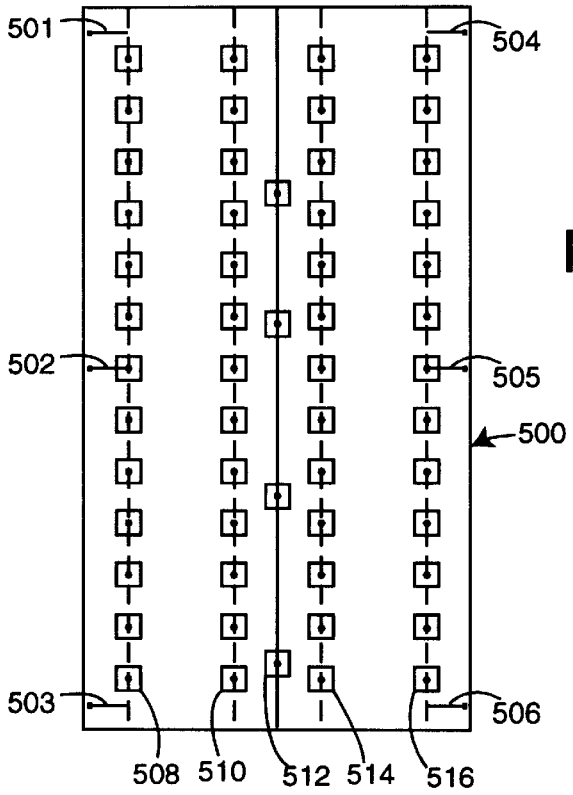
Fig. 5A
Fig. 5B
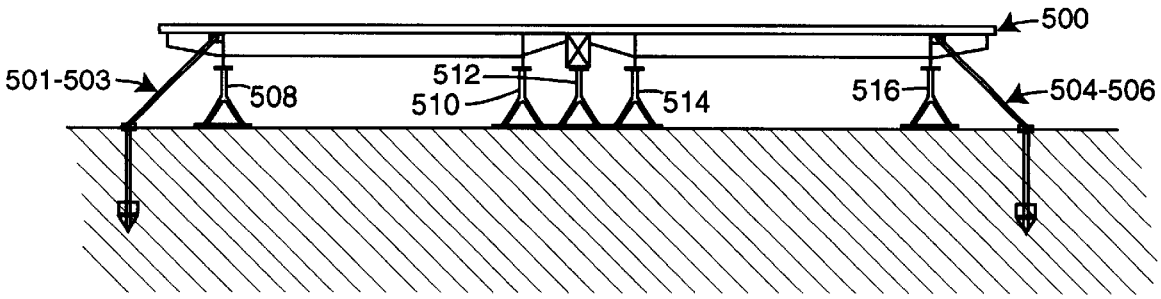

DEADMAN GROUND-ANCHOR

BACKGROUND OF THE INVENTION

1. Field of the Invention

The present invention relates to ground anchors, and more particularly to deadman anchors able to secure modular buildings subject to earthquake, high winds, and floods.

2. Description of Related Art

Natural disasters such as floods and earthquakes cause far more damage than is necessary when equipment, fixtures, and buildings come loose and are allowed to knock about. Floods in particular are able to float propane tanks off their foundations and carry them away. Such floating tanks can easily collide with other debris and explode. Mobile homes that would otherwise suffer relatively minor damage can be completely destroyed if they are bounced off their foundations or support jacks during an earthquake.

Of course many anchoring methods and devices exist that could be used in these and similar situations. But the prior art anchoring methods and devices available are usually expensive and/or not all that satisfactory.

Soil anchors are well-known. Some need to have a hole excavated and the anchor buried in the hole. Others screw themselves into the ground and are expected to resist being pulled out. Tents of all sizes have been anchored by tethers that are tied off to spikes driven into the ground. Such spikes are best driven in at right angles to the expected load so that they don't pull out so easily.

However, when extreme forces are applied to prior art soil anchors, they pull out because the installation loosened the soil they're embedded in, and/or too little lateral area in the soil is being loaded.

Boyce Cockman describes a screw-in type post anchor in U.S. Pat. No. 4,923,165, issued May 8, 1990. He admits that a problem occurs in loosening the soil in which the anchor is expected to grip. So the solution proposed is to squeeze the soil in a vice arrangement after the anchor is in place. The problem with trying to recompact the disturbed soil this way is the plug of recompacted soil forms a cylinder that is not well anchored to the undisturbed soil surrounding the anchor.

A drive anchor with retaining flukes was described by M. A. Jackson, in U.S. Pat. No. 3,302,347, issued Feb. 7, 1967. A power hammer is used to drive a ground anchor into place. A metal shaft with a pointed end has flukes welded to it to form what looks like an arrowhead. A tailpiece of each fluke is not welded to the shaft behind a radial bend-groove. The fluke tailpieces bend on the bending groove and flip out when the drive anchor is forcibly rotated or tugged. The bent pieces thereafter lock the drive anchor in essentially undisturbed compacted earth. However, a large amount of force is usually needed to get the bending grooves to fold, and the folded metal is thus weakened and exposed to rust.

SUMMARY OF THE INVENTION

An object of the present invention is to provide a soil anchor that is effective and useful where extreme tensile loading will occur.

Another object of the present invention is to provide a soil anchor that is simple and easy to insert into the ground and that does not loosen the naturally compacted soil it needs to anchor within.

Briefly, a deadman anchor embodiment of the present invention comprises a heavy steel rod with several inches of machine threading at a back end, and an arrowhead with a pair of wedge-shaped wings at a front end. The wedge-shaped wings are welded to the steel rod. A pivotable fluke is hinged to the shaft with a lateral pin. The whole unit is driven into the soil with a pneumatic jack-hammer until the threads at the back end are almost completely buried. A stabilizer vane and interlocking cap are then placed over the end flat on the ground. Nuts are put over the threaded end and tightened so that the whole unit is drawn back out a few inches. The fluke folds out perpendicular to the shaft and locks compacted soil between it and the cap. The stabilizing vane braces the top end of the anchor against lateral forces.

An advantage of the present invention is that a soil anchor is provided that is effective and useful where extreme tensile loading will occur.

Another advantage of the present invention is that a soil anchor is provided that is simple and easy to insert into the ground and that does not loosen the naturally compacted soil it needs to anchor within.

The above and still further objects, features, and advantages of the present invention will become apparent upon consideration of the following detailed description of specific embodiments thereof, especially when taken in conjunction with the accompanying drawings.

BRIEF DESCRIPTION OF THE DRAWINGS

FIGS. 2A and 2B are front and side views of a deadman ground-anchor embodiment of the present invention with the stabilizer vane and interlocking cap removed;

FIGS. 3A and 3B are front and top views of a stabilizer vane for the deadman ground-anchor embodiment of the present invention shown in FIGS. 2A and 2B;

FIGS. 4A, 4B, and 4C are top, side, and front views of an interlocking cap for the deadman ground-anchor embodiment of the present invention shown in FIGS. 2A, 2B, 3A, and 3B; and FIGS. 5A and 5B are plan and end view diagrams of a modular building showing the placement of several deadman anchors and their connection with rigid struts.

DETAILED DESCRIPTION OF THE INVENTION

Figure 1A:
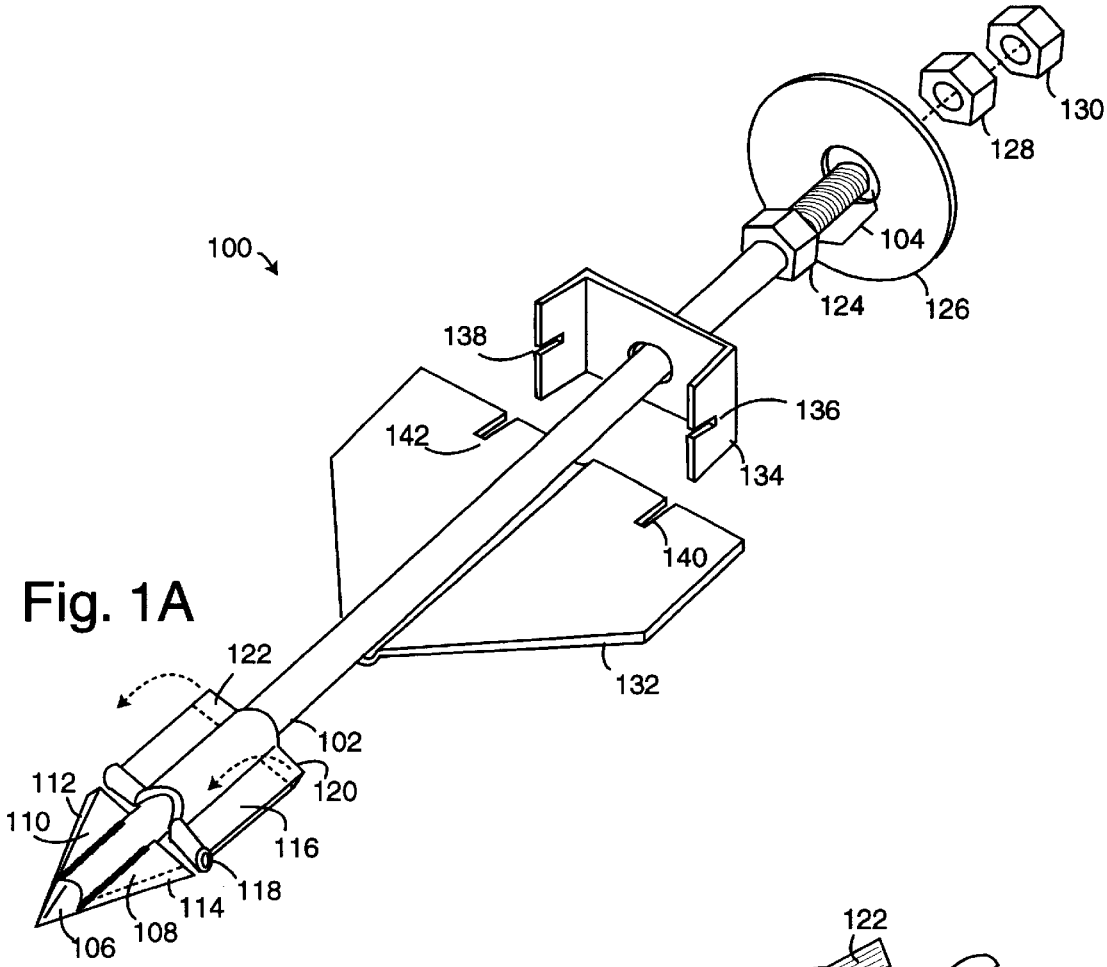
FIGS. 1A and 1B are perspective and exploded assembly views of a deadman ground-anchor embodiment of the present invention.
Figure 1B:
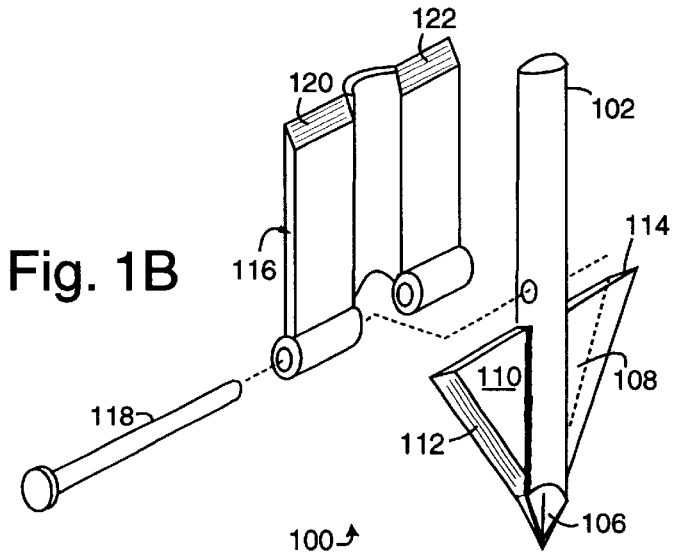

FIGS. 1A and 1B illustrate a deadman anchor embodiment of the present invention, referred to herein by the reference numeral 100. The deadman anchor 100 comprises a steel shaft 102 with a threaded top end 104 and a sharpened pointed end 106. A pair of knife-edge fins 108 and 110 are meant to cut through the soil as the deadman anchor is pounded into the ground with a jack-hammer. A corresponding pair of bevel edges 112 and 114 are ground on the fins. A pivotable fluke 116 is hinged to the shaft with a pin 118. A pair of trailing edge bevels 120 and 122 are cut on the same side so that the fluke 116 will flip out and lock perpendicular to the shaft 102 if the deadman anchor is driven down into the ground and tugged back up. A nut 124 is threaded down on end 104 and covered, e.g., with a large washer 126. A couple more nuts 128 and 130 are provided to fasten above-ground hardware to the anchor. A stabilizer 132 is locked into the upper end of the anchor by a cap 134. A system of interlocking slots 136, 138, 140, and 142, keep the stabilizer in place.

FIGS. 2A and 2B illustrate a deadman anchor embodiment of the present invention, referred to herein by the reference numeral 200. The deadman anchor 200 is shown in FIG. 2A with a steel shaft 202 and a fluke 204 folded up in the position it would be in as the anchor was being driven down into the ground. FIG. 2B shows how the fluke 204 can fold out in the position it would assume if the buried anchor was tugged a bit back out of the ground. A deadman anchor stem for use with mobile coaches can be from thirty inches to fifty-four inches long with a diameter of from ½" to 1". One typical deadman anchor stem is forty-three inches long with a diameter of ⅞". The top ten inches of the stem are machine-threaded. The fins and fluke are made of 3⁄16" to ¼" plate steel.

FIGS. 3A and 3B show a stabilizer vane 300 that can be used on the deadman ground-anchor 200 (FIGS. 2A and 2B). The purpose of the stabilizer vane is to brace the top end of the stem of the deadman anchor against lateral movement. A rounded groove 302 is welded to a pipe section 304 all along its central longitudinal axis. Such pipe section preferably allows a ⅞" diameter stem of a ground anchor to easily slip through. The outline of the vane has a swept wing cut to it so that it will drive through the soil easier. A pair of slots 306 and 308 on the trailing edge are provided for an interlocking cap. The slots 306 and 308 are equidistant from the groove 302 and are at least one inch deep. A typical stabilizer plate for use with mobile coaches is twelve inches tall with a wingspan of twelve inches, but can be up to twenty-four inches tall with a wingspan of twenty-four inches.

FIGS. 4A, 4B, and 4C represent an interlocking cap 400 to fit the deadman ground-anchor 200 (FIGS. 2A and 2B) and the stabilizer vane 300 (FIGS. 3A, and 3B). The cap 400 has a bolt hole 402 for passing the deadman anchor's stem through, and a pair of folded ends 404 and 406. Such bolt hole 402 preferably fits the top end of the pipe section 304 (FIG. 3B). A slot 408 represents slots that are preferably included in both the folded ends 404 and 406 and that interlock with similar slots in a stabilizer vane, e.g., slots 306 and 308 in FIGS. 3A and 3B. A typical cap for use with mobile coaches is six inches square with two-inch folded ends. Thus, the folded ends 404 and 406 are twice the depth of slots 306 and 308.

FIGS. 5A and 5B show the floor system of a modular building 500 and the placement of several anchors 501–506. On the left, a first row of piers are represented by a pier 508. A second row by a pier 510. A middle row under a main girder is represented by a pier 512. A fourth row, right of center, is represented by a pier 514. A farthest-right row of piers is represented by a pier 516. Each of the six anchors 501–506 has a rigid bracing strut of box-tube steel that diagonally connects down to a buried deadman anchor like those illustrated here in FIGS. 1A, 1B, 2A, 2B, 3A, 3B, and 4A–4C. The bracing struts are preferably constructed with telescoping sections that have been pinned together by bolts after both ends have been secured in their final positions. The stabilizing vanes of the respective deadman anchors are oriented for maximum advantage, e.g., broadside to the building.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A deadman ground-anchor, comprising:

a stem with a pointed end and an opposite machine-threaded end;

a pair of arrowhead fins attached to the stem at said pointed end;

a pivotable fluke attached to the stem just aft of the pair of arrowhead fins;

a lateral pin that transversly hinges the fluke to the stem so that the fluke can both fold flat and fold out near perpendicular to the stem;

a stabilizer vane that slips down over said machine-threaded end of the stem after the anchor has been buried in the ground, and that provides for lateral reinforcement of said machine-threaded end of the stem against side thrusts; and a cap that also slips down over said machine-threaded end of the stem and interlocks with the stabilizer vane.

2. The deadman anchor of claim 1, further comprising:

a nut that is threaded on said machine-threaded end of the stem over the cap, and when tightened causes a pull-back movement for forcing the fluke to fold out into its perpendicular position while the anchor is buried in the ground.

3. The deadman anchor of claim 1, wherein:

the stabilizing vane is oriented broadside to an expected lateral load applied to an above-ground part of the anchor.

4. The deadman anchor of claim 1, further comprising:

a rigid strut for connecting between a modular building on piers and said machine-threaded end of the stem over the cap;

wherein, the stabilizing vane is buried and oriented in the ground broadside to said modular building.

* * * * *